US006398309B1

(12) United States Patent
Chen

(10) Patent No.: US 6,398,309 B1
(45) Date of Patent: Jun. 4, 2002

(54) LEVEL-ADJUSTABLE AND SWIVELABLE ARMREST ASSEMBLY

(76) Inventor: Su-Jan Chen, NO.200, Lane 545, Section 1, Yung Hsing Road, Wu-Chi, Taichung Hsien (TW)

( * ) Notice: Subject to any disclaimer, the term of this patent is extended or adjusted under 35 U.S.C. 154(b) by 0 days.

(21) Appl. No.: 09/899,379

(22) Filed: Jul. 5, 2001

(51) Int. Cl.[7] ..... A47C 7/54
(52) U.S. Cl. ..... 297/411.36
(58) Field of Search ..... 297/411.36, 353, 297/410

(56) References Cited

U.S. PATENT DOCUMENTS 5,388,892 A * 2/1995 Pornero ..... 297/411.36
5,393,125 A * 2/1995 Watson et al. ..... 297/411.36
6,053,579 A * 4/2000 Nelson et al. ..... 297/411.36
6,209,840 B1 * 4/2001 Chen ..... 297/411.36

* cited by examiner

*Primary Examiner*—Peter R. Brown
(74) *Attorney, Agent, or Firm*—Alan Kamrath; Rider, Bennett, Egan & Arundel, LLP

(57) ABSTRACT

An armrest assembly includes a tube secured to a chair seat and an adjusting seat mounted in the tube. An actuating member includes a vertical section slidably received in a longitudinal groove of the adjusting seat. A slide member is slidably attached to the vertical portion of the actuating member to move therewith. An armrest is securely mounted to the actuating member to move therewith. An operative member is securely attached to the slide member for manual operation. Two positioning members are respectively, releasably engaged with two sets of vertically spaced positioning notches in the adjusting seat under the control of the slide member that is moved by the operative member.

19 Claims, 10 Drawing Sheets

B - B

A - A

B - B

LEVEL-ADJUSTABLE AND SWIVELABLE ARMREST ASSEMBLY

BACKGROUND OF THE INVENTION

1. Field of the Invention

The present invention relates to an armrest assembly that is adjustable in level and swivelable to provide the user with comfortable sitting.

2. Description of the Related Art

FIGS. 9 and 10 illustrate a conventional level-adjusting device for an armrest of a chair. The level-adjusting device includes a fixing seat 1' and an adjusting seat 2'. A retainer 3' is secured between the fixing seat 1' and the adjusting seat 2' by a screw 7' for retaining the fixing seat 1' in place. A side of the retainer 3' is born against by a spring 6' and an upper side of the retainer 3' is biased by an elastic plate 4'. A positioning plate 5' is mounted on top of the retainer 3' and the elastic plate 4'. The retainer 3, may slide along a vertical slide passage 13' in the fixing seat 1' and be selectively engaged with one of a number of positioning notches 12' in the fixing seat 1'. The retainer 3' is retained in a selected positioning notch 12' upon changing angular position of the elastic plate 4' for positioning the retainer 3' and the screw 7'. Although the device may provide the required height-adjusting function, the assembly procedure for the retainer 3' and the spring 6' as well as other elements is relatively difficult and thus has a high cost. The overall structure is weak and the adjusting movement is not reliable, as there are too many elements.

U.S. Pat. No. 6,209,961 to Applicant issued on Apr. 3, 2001 discloses a level-adjustable and swivelable armrest assembly to solve the above-mentioned problems. The present invention provides a different design in this regard.

SUMMARY OF THE INVENTION

It is a primary object of the present invention to provide an armrest assembly that is adjustable in level and swivelable to provide the user with comfortable sitting.

In accordance with an aspect of the invention, an armrest assembly comprises:

a tube adapted to be secured to a chair seat;

an adjusting seat mounted in the tube and including a longitudinal groove and at least one set of positioning notches that are spaced vertically;

an armrest mounted above the adjusting seat;

an actuating member secured to the armrest to move therewith, the actuating member further including a vertical section slidably received in the longitudinal groove of the adjusting seat;

a slide member slidably attached to the vertical portion of the actuating member;

an operative member securely attached to the slide member for manual operation; and at least one positioning member releasably engaged with one of the positioning notches of said at least one set;

wherein when the operative member is in an inoperative position, said at least one positioning member is retained in a position by the slide member to thereby engage with one of the positioning notches of said at least one set; and wherein when the operative member is moved to an operative position, the slide member slides relative to the actuating member to a position in which the slide member abuts against the actuating member, and said at least one positioning member is disengaged from the positioning notches of said at least one set to a position for simultaneous movement with the slide member, and further vertical movement of the operative member causes the slide member and the actuating member to move vertically until the armrest reaches a desired level.

Each positioning notch includes an opening that faces downward and inward. The vertical section of the actuating member includes a groove. A follower is securely attached to the slide member to move therewith. In an embodiment of the invention, the follower is secured to the slide member by a screw that extends into the groove of the actuating member. The screw presses against an edge of the groove of the actuating member when the operative member is in the operative position to thereby allow synchronous movement of the slide member and the actuating member.

The vertical section of the actuating member includes a protrusion, and the adjusting seat includes a vertical slide groove for slidably receiving the protrusion of the actuating member. A sleeve is slidably mounted around the tube and securely engaged with the armrest to move therewith. In an embodiment of the invention, the sleeve includes an opening. The operative member has a portion extended through the opening of the sleeve and securely engaged with the slide member to move therewith. The operative member presses against an edge of the opening of the sleeve when the operative member is in the operative position to thereby allow synchronous movement of the operative member and the sleeve.

The vertical section of the actuating member includes a screw hole, and the slide member includes a vertically extending slot. A screw extends through the vertically extending slot of the slide member into the screw hole of the actuating member, thereby guiding vertical movement of the slide member relative to the actuating member.

The tube includes a plurality of angularly spaced positioning holes. A positioning element is mounted to the adjusting seat. Means, such as a ball, is provided for biasing the positioning element to releasably engage with one of the positioning holes, thereby allowing the armrest to be swiveled relative to the chair seat. In an embodiment of the invention, the adjusting seat includes a first cylindrical half and a second cylindrical half, wherein the angularly spaced positioning holes are defined in the first cylindrical half, and the positioning notches are defined in the second cylindrical half.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
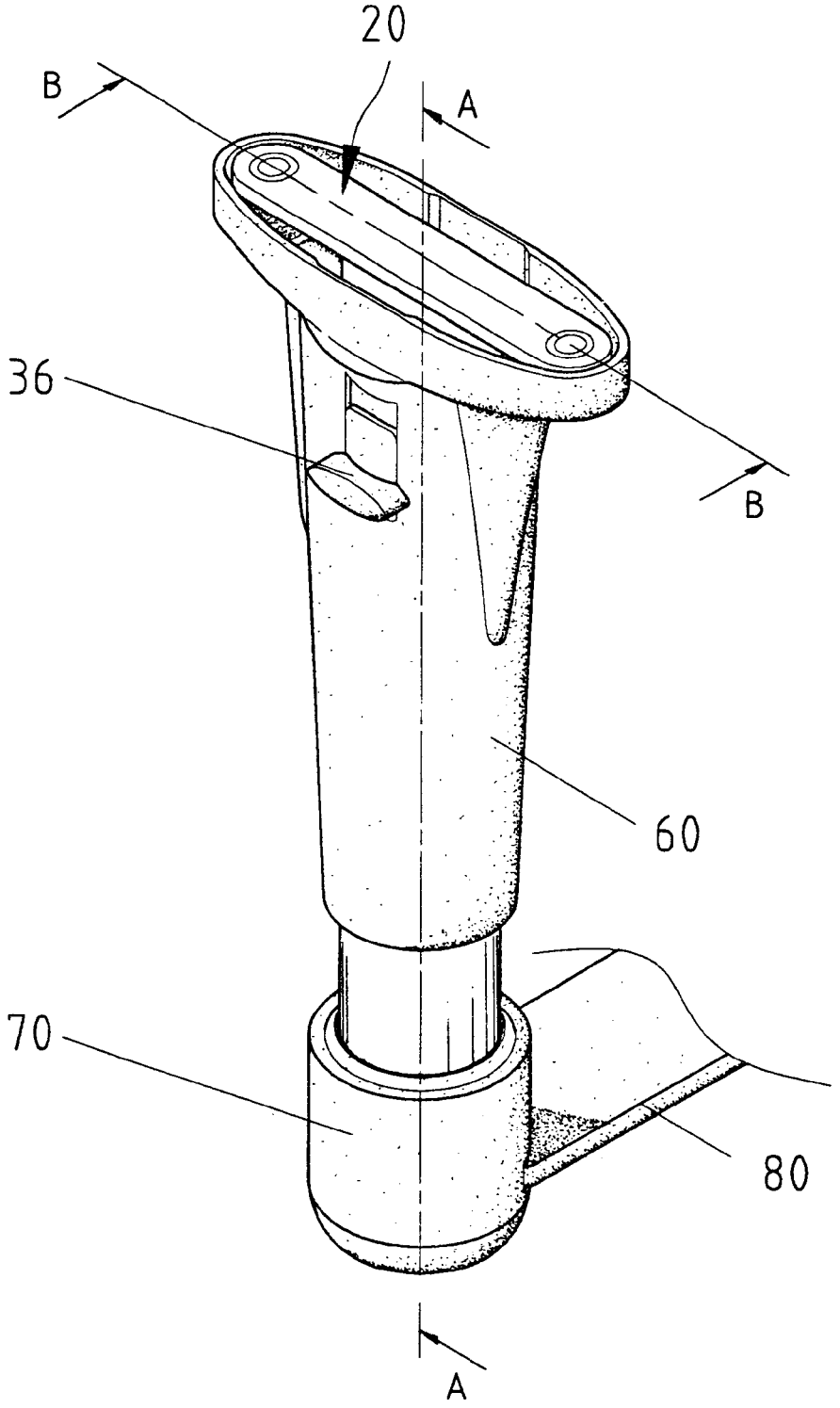
FIG. 1 is a perspective view of an armrest assembly in accordance with the present invention, wherein the armrest is removed for showing the inner structure.
Figure 2:
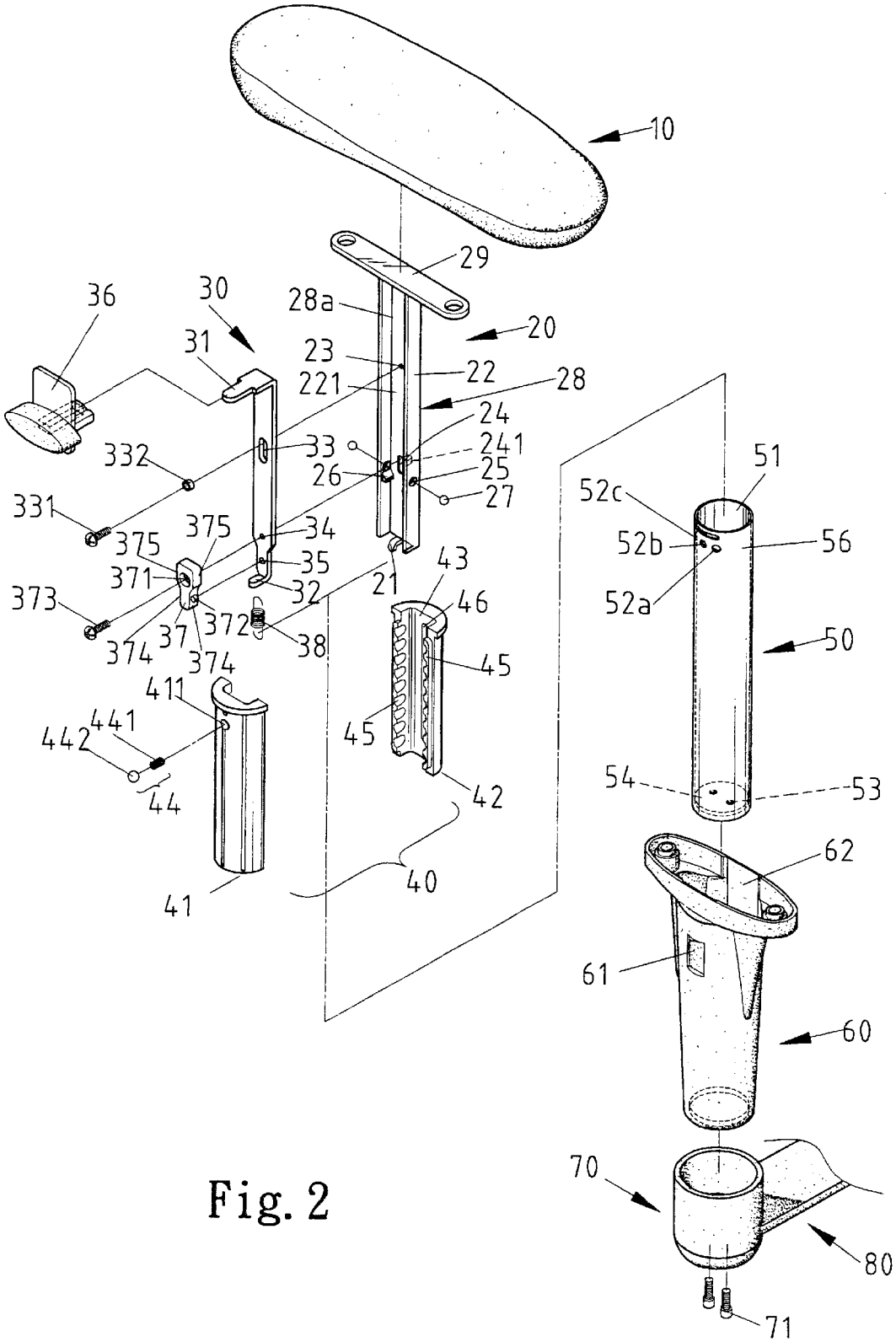
FIG. 2 is an exploded perspective view of the armrest assembly in accordance with the present invention.

Referring to FIGS. 1 through 8 and initially to FIGS. 1 and 2, an armrest assembly in accordance with the present invention generally includes an armrest 10, an actuating member 20, a slide member 30, an adjusting seat 40, a tube 50, a sleeve 60, and a mounting seat 70 securely attached to a char seat 80. The tube 50 includes a lower end 54 that is secured to the chair seat 80 by means of extending screws 71 through the chair seat 80 and the mounting seat 70 and screw holes 53 defined in the lower end 54 of the tube 50. An upper end 56 of the tube 50 includes, e.g., three angularly spaced positioning holes 52*a,* 52*b,* and 52*c,* which will be described later.

The adjusting seat 40 is swivelably mounted in the tube 50. The actuating member 20 is substantially T-shaped and includes a vertical section 28 slidably mounted in the adjusting seat 40 and a horizontal section 29 secured to the armrest 10. Namely, the upper end (namely the section 29) of the actuating member 20 is fixed to the armrest 10 to move therewith. In addition, the sleeve 60 is slidably mounted around the tube 50 and includes an upper end 62 that is also fixed to the armrest 10 to move therewith. Thus, the actuating member 20 will be moved vertically when the sleeve 60 is manually moved vertically. The sleeve 60 further includes an opening 61, which will be described later.

In this embodiment, the vertical section 28 of the actuating member 20 comprises a bottom wall 28*a* and two lateral walls 22 on both sides of the bottom wall 28*a,* thereby defining a compartment 221. Each lateral wall 22 comprises a hole 25 for receiving a positioning member 27, such as a ball. Each lateral wall 22 further comprises a stop 26, and the bottom wall 28*a* comprises a protrusion 241 on a side thereof and a groove 24 on the other side thereof.

Figure 3:
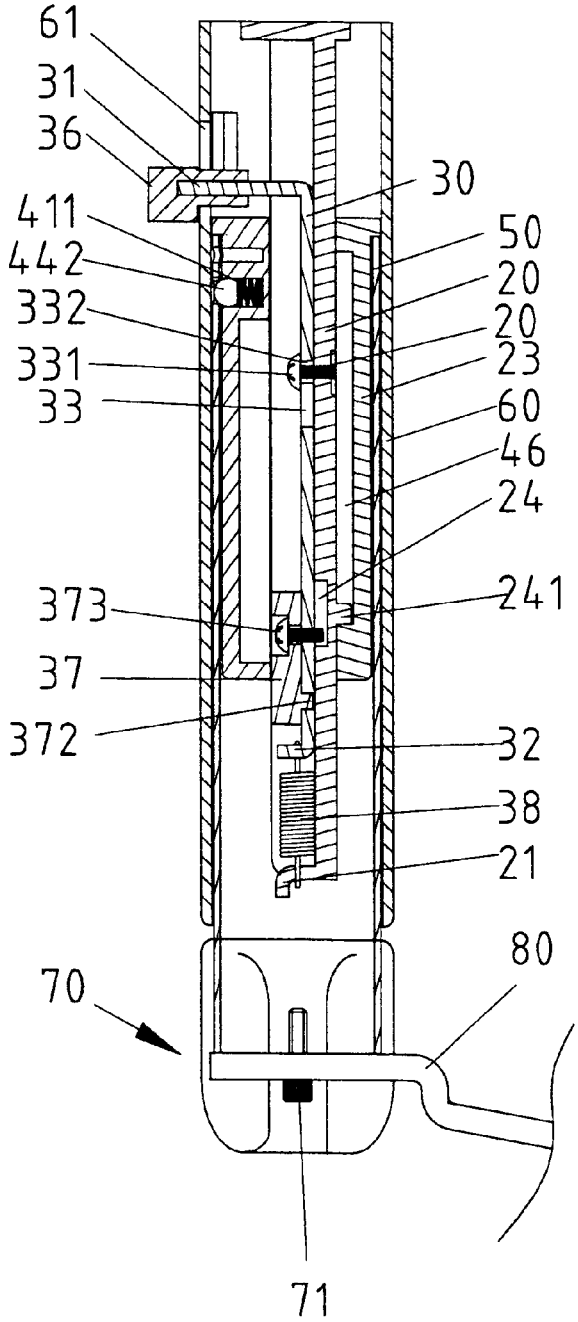
FIG. 3 is a sectional view taken along line A—A in FIG. 1.
Figure 4:
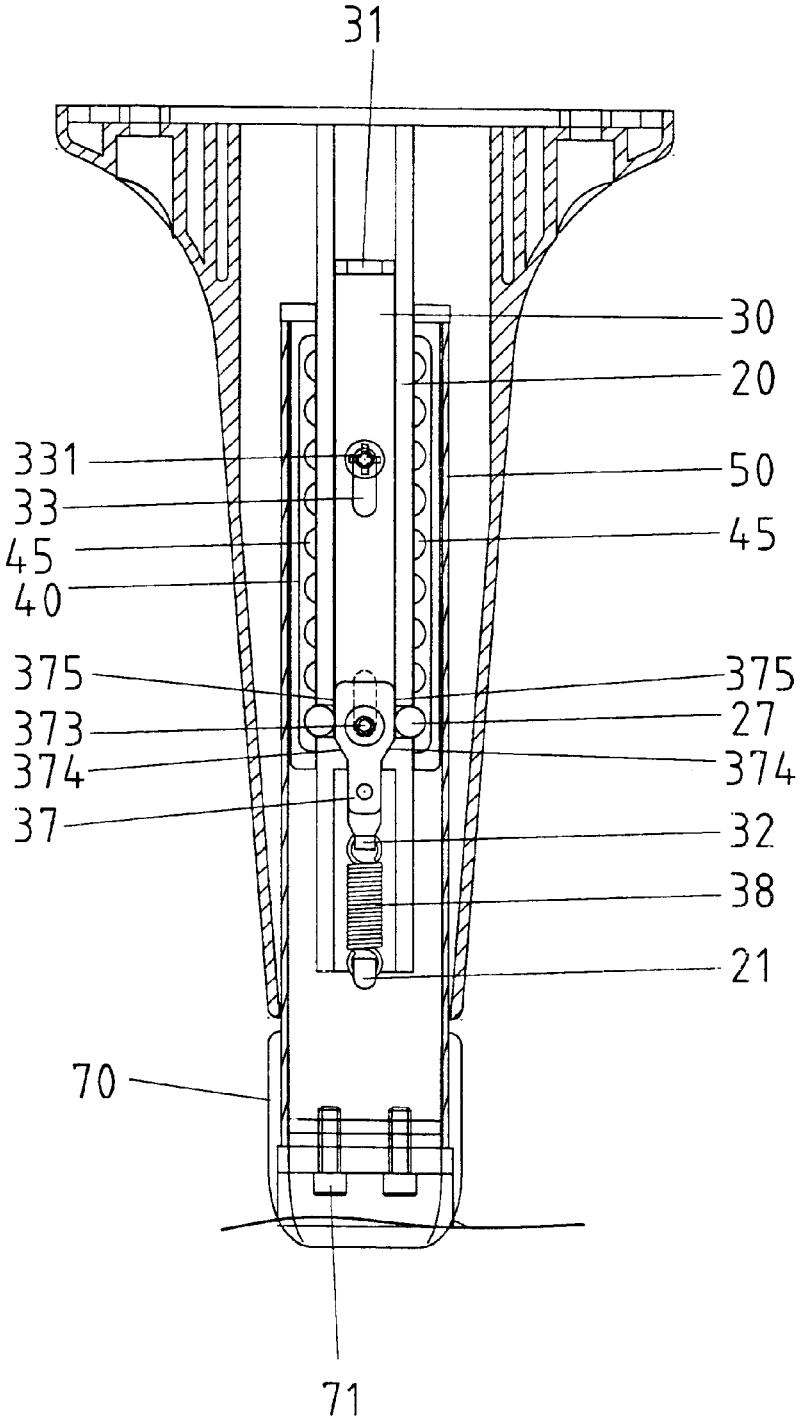
FIG. 4 is a sectional view taken along line B—B in FIG. 1.

In this embodiment, the adjusting seat 40 comprises two cylindrical halves 41 and 42 that together define a longitudinal groove 41 along a length thereof. The cylindrical half 42 comprises two sets of positioning notches 45 that are preferably diametrically opposed. Each positioning notch 45 includes an opening that faces downward and inward. The cylindrical half 42 further comprises a slide groove 46 for receiving and guiding the protrusion 241 of the actuating member 20, best shown in FIG. 3. When the vertical section 28 of the actuating member 20 is inserted into the longitudinal groove 43 of the adjusting seat 40, each ball 27 is received in an associated hole 25 and an associated positioning notch 45, as shown in FIG. 4.

The cylindrical half 41 includes a transverse receptacle 411 for receiving an elastic means 44 consisting of an elastic element 441 and a ball 442. The ball 442 is biased radially outward by the elastic element 441 and thus partially protruded into one of the positioning holes, e.g., 52*b.* When the user swivels the armrest 10, the adjusting seat 40 is swiveled, as the vertical section 28 of the actuating member 20 is engaged in the longitudinal groove 41 of the adjusting seat 40. As a result, the ball 442 is moved inward into the transverse receptacle 411 and moves together with the adjusting seat 40 until the ball 442 is aligned with another positioning hole, e.g., 52*c.* The ball 442 is then biased radially outward by the elastic element 441 and thus partially protruded into and retained in the positioning hole 52*c.* Thus, the armrest 10 may be swiveled among a plurality of angular positions relative to the seat 80 to provide comfort resting for the user's arm. It is noted that the ball 442 may be substituted by other positioning elements, such as a pin with a dome. Similar structure and operation for the swivel arrangement of the armrest have been disclosed in U.S. Pat. No. 6,209,961, which is incorporated herein for reference.

Turning back to FIG. 2, the slide member 30 comprises an upper end 31 to which an operative member 36 is securely attached and a lower end 32 to which an end of an elastic element (such as a spring 38) is securely attached. The other end of the spring 38 is attached to the hook 21 of the actuating member 20. In this embodiment, as illustrated in FIG. 3, the upper end 31 of the slide member 30 is extended through the opening 61 of the sleeve 60 to allow easy engagement with the operative member 36 that has a portion exposed outside the sleeve 60 for manual operation. The slide member 30 further includes a vertically extending slot 33 for receiving a nut 332, and a screw 331 is extended through the nut 332 into the screw hole 23 of the actuating member 20, best shown in FIG. 3. Thus, the slide member 30 is moved upward when the operative member 36 is pulled upward, and the vertical movement of the slide member 30 is guided by the slot 33 and the screw 331.

The slide member 30 further comprises a screw hole 34 and a hole 35 adjacent to the lower end 35 thereof. A screw 373 is extended through a hole 371 in a follower 37 and the screw hole 34 and into the groove 24 of the actuating member 20, thereby securely attaching the follower 37 to the slide member 30 to move therewith, best shown in FIG. 3. The follower 37 comprises two inclined faces 373 respectively on two opposite lateral walls 375 thereof for cooperating with the balls 27, which will be described later. The follower 37 further comprises a peg 372 that engages with the hole 35 to provide reliable attachment of the follower 37 to the slide member 30. However, the follower 37 may be integral with the slide member 30.

Turning to FIGS. 3 and 4, it is noted that the armrest 10 is in its lowest position and the protrusion 241 of the actuating member 20 is in its lowest position in the slide groove 46 of the adjusting seat 40. Each ball 27 is engaged in the lowest one of the associated set of positioning notches 45 under the action of two opposite lateral walls 375 of the follower 37.

Figure 5:
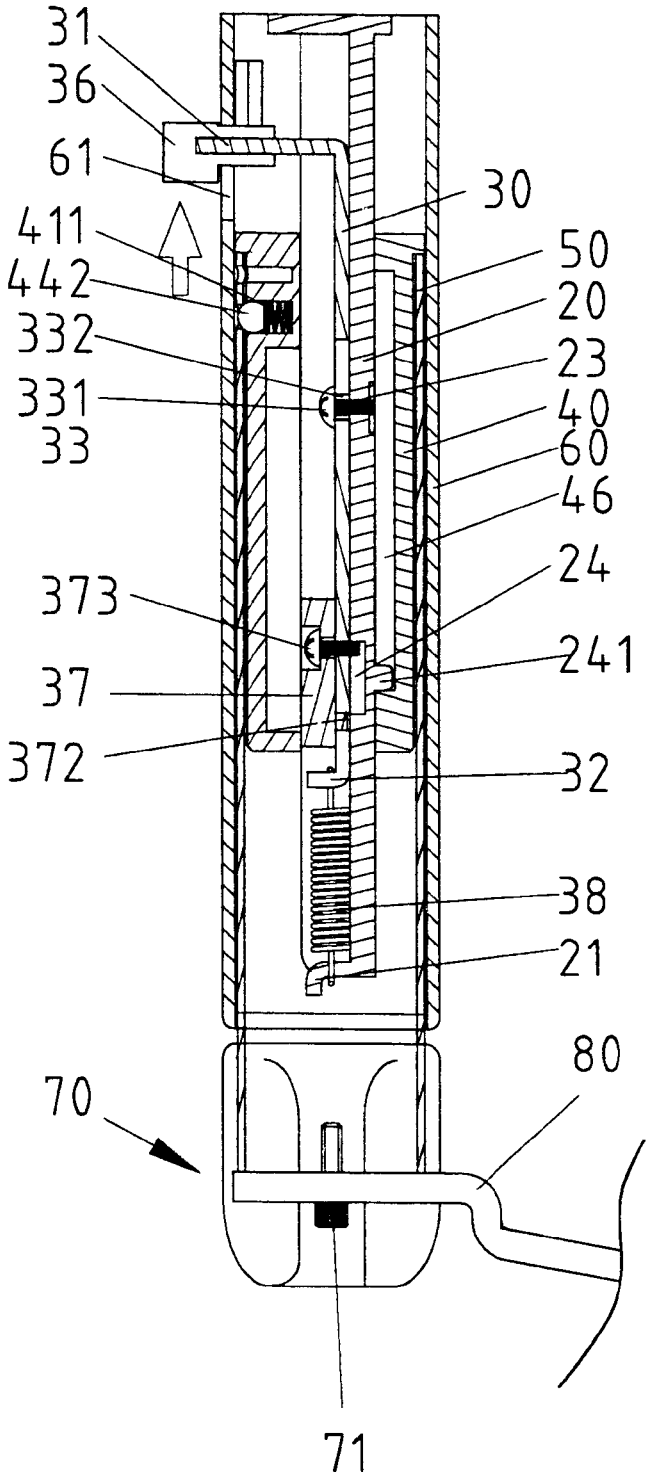
FIG. 5 is a sectional view similar to FIG. 3, wherein an operative member is pulled upward to allow adjustment in level of the armrest.
Figure 6:
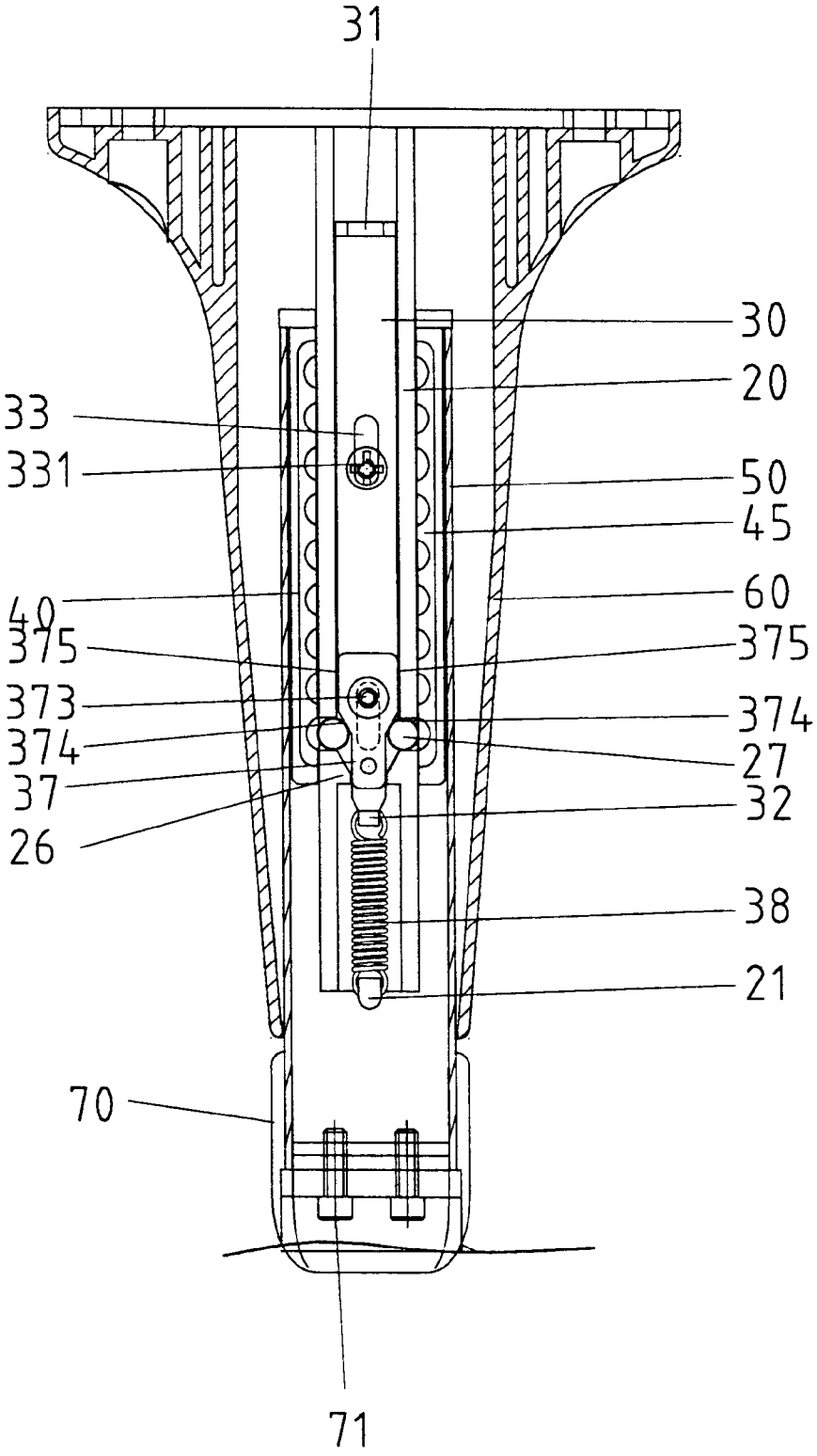
FIG. 6 a sectional view similar to FIG. 4, wherein the operative member is pulled upward to adjustment in level of the armrest.

When adjustment in the level of the armrest 10 is required, the user pulls the operative member 36 upward, as illustrated in FIG. 5. The slide member 30 and the follower 37 are moved upward. As illustrated in FIG. 6, since each positioning notch 45 includes an opening that faces downward and outward, each ball 27 moves inward and engages with the associated inclined face 374 of the follower 37 and thus completely disengages from the associated positioning notch 45. It is noted that the sliding movement of the follower 37 and the slide member 30 is further guided by the groove 24 of the actuating member 20 and the screw 373, best shown in FIG. 5.

Figure 7:
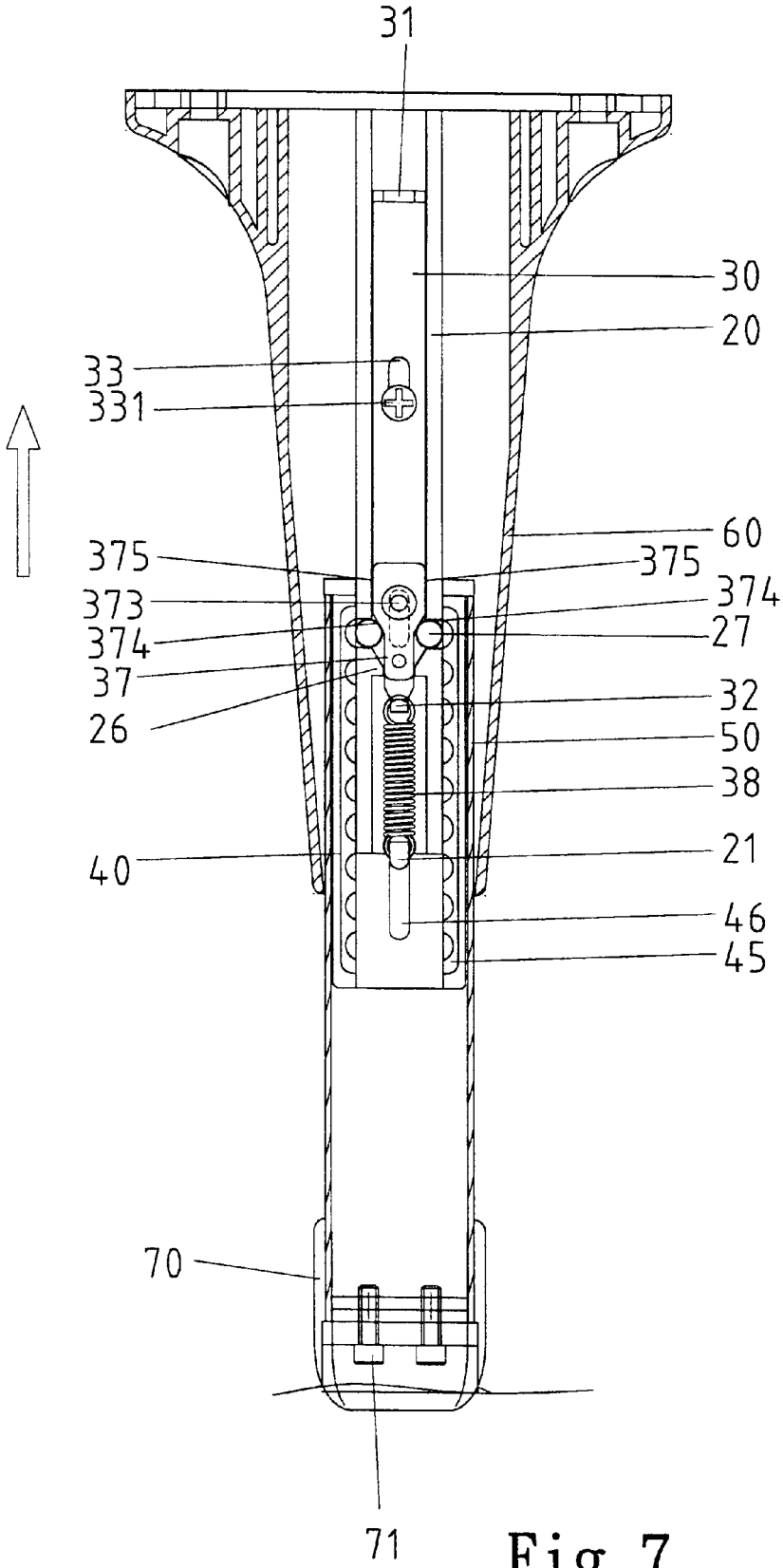
FIG. 7 is a sectional view similar to FIG. 3, wherein the armrest is moved to a highest level.
Figure 8:
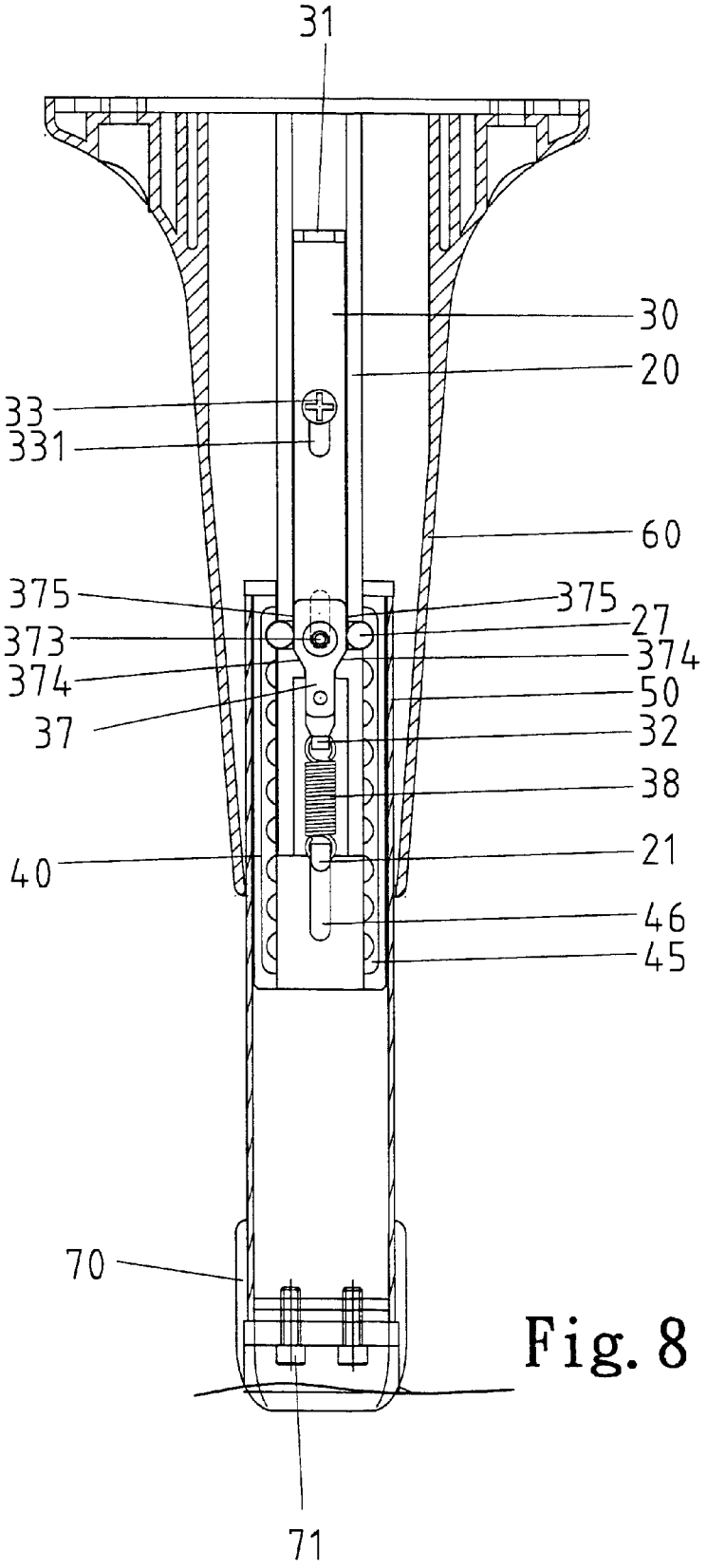
FIG. 8 is a sectional view similar to FIG. 7, wherein the armrest is retained in place.
Figure 9:
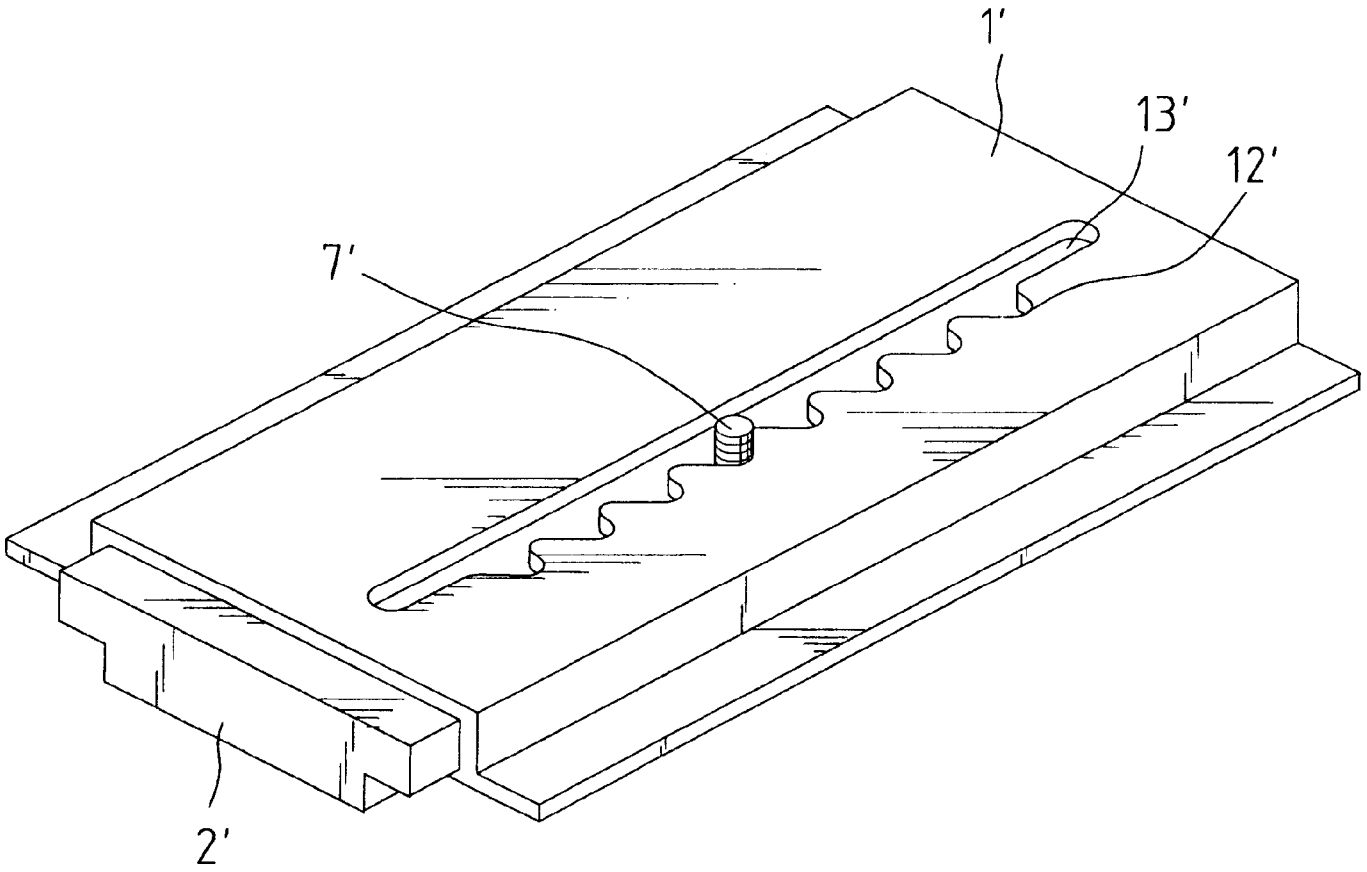
Fig. 9 PRIOR ART
FIG. 9 is a perspective view of a conventional level-adjusting device for an armrest.
Figure 10:
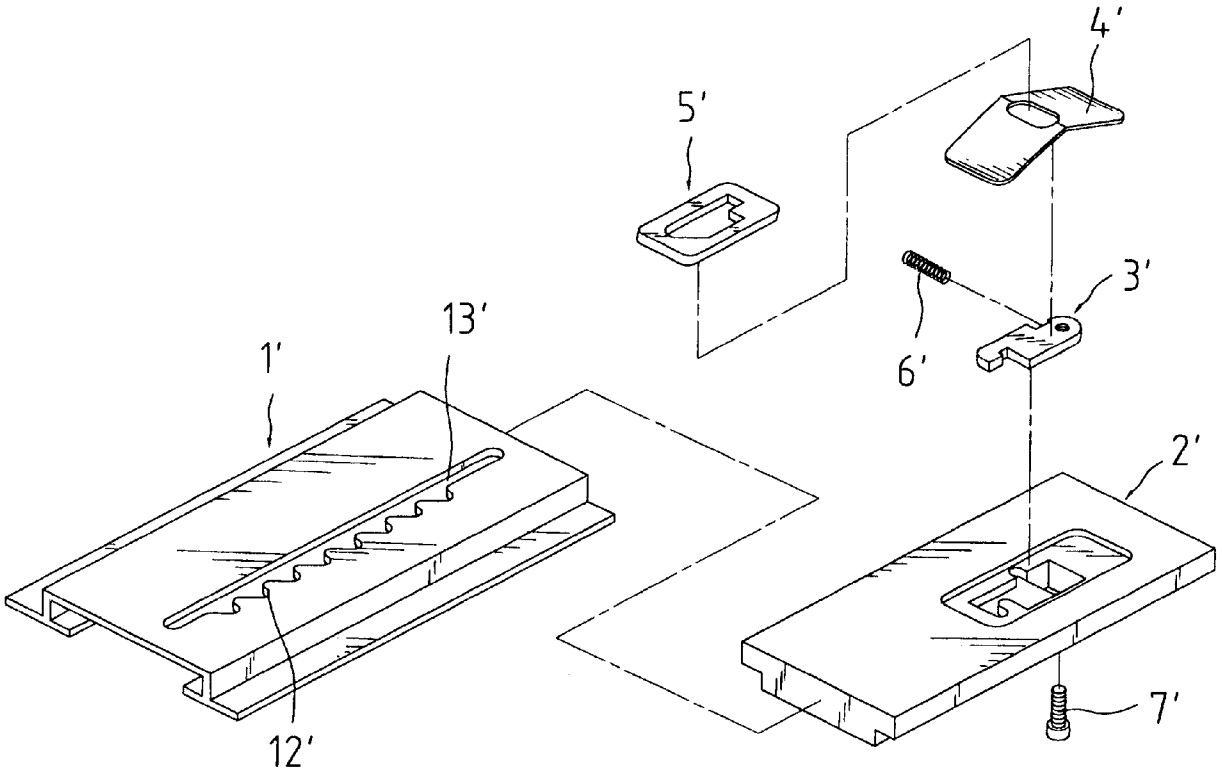
Fig. 10 PRIOR ART
FIG. 10 is an exploded perspective view of the conventional level-adjusting device in FIG. 10.

As illustrated in FIG. 5, the operative member 36 bears against an upper edge of the opening 61 of the sleeve 60, the screw 373 bears against the upper edge of the groove 24 of the actuating member 20. Thus, further upward movement of the operative member 36 causes the actuating member 20, the sleeve 60, and the armrest 10 to move upward. The balls 27 are carried by the follower 37 and the slide member 30 that moves upward (or downward), as shown in FIG. 7. When the armrest reaches the desired level, e.g., the highest position shown in FIG. 7, the user releases the operative member 36, which results in downward movement of the operative member 36, the slide member 30, and the follower 37 under the action of the spring 38. Each ball 27 will be moved outward by the associated inclined face 374 and then the vertical portion of the associated lateral wall 375 of the follower 37 into the associated positioning notch 45 at the desired level, thereby positioning the armrest 10, the sleeve 60, and the actuating member 20 in place, best shown in FIG. 8. The adjustment in the level of the armrest 10 can be easily achieved with a reliable positioning effect.

Although the invention has been explained in relation to its preferred embodiment, it is to be understood that many other possible modifications and variations can be made without departing from the spirit and scope of the invention as hereinafter claimed.

What is claimed is:

1. An armrest assembly comprising:

a tube adapted to be secured to a chair seat;

an adjusting seat mounted in the tube and including a longitudinal groove and at least one set of positioning notches that are spaced vertically;

an armrest mounted above the adjusting seat;

an actuating member secured to the armrest to move therewith, the actuating member further including a vertical section slidably received in the longitudinal groove of the adjusting seat;

a slide member slidably attached to the vertical section of the actuating member;

an operative member securely attached to the slide member for manual operation; and at least one positioning member releasably engaged with one of the positioning notches of said at least one set;

wherein when the operative member is in an inoperative position, said at least one positioning member is retained in a position by the slide member to thereby engage with one of the positioning notches of said at least one set; and wherein when the operative member is moved to an operative position, the slide member slides relative to the actuating member to a position in which the slide member abuts against the actuating member, and said at least one positioning member is disengaged from the positioning notches of said at least one set to a position for simultaneous movement with the slide member, and further vertical movement of the operative member causes the slide member and the actuating member to move vertically until the armrest reaches a desired level.

2. The armrest assembly as claimed in claim 1, wherein each said positioning notch includes an opening that faces downward and inward.

3. The armrest assembly as claimed in claim 1, wherein the vertical section of the actuating member includes a groove, further comprising a follower securely attached to the slide member to move therewith, the follower being secured to the slide member by a screw that extends into the groove of the acting member, the screw pressing against an edge of the groove of the actuating member when the operative member and the operative position to thereby allow synchronous movement of the slide member and the actuating member.

4. The armrest assembly as claimed in claim 3, wherein the vertical section of the actuating member includes a protrusion, the adjusting seat including a vertical slide groove for slidably receiving the protrusion of the actuating member.

5. The armrest assembly as claimed in claim 3, further comprising a sleeve slidably mounted around the tube, the sleeve being securely engaged with the armrest to slide therewith.

6. The armrest assembly as claimed in claim 3, wherein the sleeve includes an opening, the operative member having a portion extending through the sleeve and securely engaged with the slide member to move therewith.

7. The armrest assembly as claimed in claim 6, wherein the operative member presses against an edge of the opening of the sleeve when the operative member is in the operative position to thereby allow synchronous movement of the operative member and the sleeve.

8. The armrest assembly as claimed in claim 3, wherein the vertical section of the actuating member includes a screw hole, the slide member including a vertically extending slot, further comprising a screw extending through the vertically extending slot of the slide member into the screw hole of the actuating member, thereby guiding vertical movement of the slide member relative to the actuating member.

9. The armrest assembly as claimed in claim 3, wherein the tube includes a plurality of angularly spaced positioning holes, further comprising:

a positioning element mounted to the adjusting seat, and means for biasing the positioning element to releasably engaged with one of the positioning holes, thereby allowing the armrest to be swiveled relative to the chair seat.

10. The armrest assembly as claimed in claim 3, wherein the adjusting seat includes a first cylindrical half and a second cylindrical half, the angularly spaced positioning holes being defined in the first cylindrical half, said at least one set of positioning notches being defined in the second cylindrical half.

11. The armrest assembly as claimed in claim 3, wherein the adjusting seat comprises two said sets of positioning notches and the armrest assembly comprises two said positioning members, the follower comprising two lateral walls each having an inclined face, each said positioning member being retained in an associated one of an associated said set of positioning notches by an associated one of the lateral walls of the follower when the operative member is in the inoperative position, each said positioning member being retained in a position held by an associated one of the inclined faces and thus carried by the follower and the slide member when the operative member is in the operative position.

12. The armrest assembly as claimed in claim 1, wherein the vertical section of the actuating member includes a protrusion, the adjusting seat including a vertical slide groove for slidably receiving the protrusion of the actuating member.

13. The armrest assembly as claimed in claim 1, further comprising a sleeve slidably mounted around the tube, the sleeve being securely engaged with the armrest to move therewith.

14. The armrest assembly as claimed in claim 13, wherein the sleeve includes an opening, the operative member having a portion extended through the opening of the sleeve and securely engaged with the slide member to move therewith.

15. The armrest assembly as claimed in claim 13, wherein the operative member presses against an edge of the opening of the sleeve when the operative member is in the operative position to thereby allow synchronous movement of the operative member and the sleeve.

16. The armrest assembly as claimed in claim 1, wherein the vertical section of the actuating member includes a screw hole, the slide member including a vertically extending slot, further comprising a screw extending through the vertically extending slot of the slide member into the screw hole of the actuating member, thereby guiding vertical movement of the slide member relative to the actuating member.

17. The armrest assembly as claimed in claim 1, wherein the tube includes a plurality of angularly spaced positioning holes, further comprising:

a positioning element mounted to the adjusting seat; and means for biasing the positioning element to releasably engage with one of the positioning holes, thereby allowing the armrest to be swiveled relative to the chair seat.

18. The armrest assembly as claimed in claim 17, wherein the positioning element is a ball, and the biasing means is an elastic element.

19. The armrest assembly as claimed in claim 18, wherein the adjusting seat includes a first cylindrical half and a second cylindrical half, the angularly spaced positioning holes being defined in the first cylindrical half, said at least one set of positioning notches being defined in the second cylindrical half.

* * * * *